US007384321B2

(12) United States Patent
Muramatsu et al.

(10) Patent No.: US 7,384,321 B2
(45) Date of Patent: Jun. 10, 2008

(54) THROTTLE OPENING CONTROLLER FOR SMALL PLANING BOAT

(75) Inventors: Hitoshi Muramatsu, Shizuoka-ken (JP); Yoshimasa Kinoshita, Shizuoka-ken (JP); Shigeaki Miyata, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 88 days.

(21) Appl. No.: 11/515,640

(22) Filed: Sep. 5, 2006

(65) Prior Publication Data

US 2007/0054570 A1 Mar. 8, 2007

(30) Foreign Application Priority Data

Sep. 2, 2005 (JP) ..... 2005-254413

(51) Int. Cl.
*B63H 21/21* (2006.01)

(52) U.S. Cl. ..... 440/87; 440/88 F

(58) Field of Classification Search ..... 440/1, 440/84, 87, 88 F; 701/21; 123/295, 304, 123/431; 73/313
See application file for complete search history.

(56) References Cited

U.S. PATENT DOCUMENTS 6,712,651 B2 * 3/2004 Kanno ..... 440/1
6,918,803 B2 * 7/2005 Shomura ..... 440/84

FOREIGN PATENT DOCUMENTS

JP 7-40476 9/1995
JP 2001-152895 6/2001
JP 2001-329881 11/2001
JP 2002-180861 6/2002
JP 2004-092640 3/2004
JP 2004-137920 5/2004

OTHER PUBLICATIONS

Co pending U.S. Appl. No. 11/335,996, filed on Jan. 20, 2006 Title: Operation Control System For Small Boat.
Co pending U.S. Appl. No. 11/451,904, filed on Jun. 12, 2006 Title: Operation Control System for Planning Boat.
Co pending U.S. Appl. No. 11/336,711, filed on Jan. 20, 2006 Title: Operation Control System for Planning Boat.

* cited by examiner

*Primary Examiner*—Lars A. Olson
(74) *Attorney, Agent, or Firm*—Knobbe, Martens, Olson & Bear LLP

(57) ABSTRACT

A throttle opening controller for one embodiment of a small planing boat includes: a throttle valve for changing the degree of opening in response to displacement of a throttle lever; a remaining fuel amount detector; a fuel consumption calculating means; and a throttle opening limiting means. In one embodiment, when a remaining fuel amount detected by the remaining fuel amount detector is equal to or below a preset value L1, the fuel consumption calculating means starts calculating total fuel injection amount. When a value, obtained by subtracting the total fuel injection amount from the preset value L1, is equal to or below a threshold L0, the throttle opening limiting means determines the degree of opening of the throttle valve based on an opening rate (k). An internal space of a fuel tank can be divided using a vertical partition into plural chambers. In addition, a knock sensor can be provided for an engine.

23 Claims, 10 Drawing Sheets

THROTTLE OPENING CONTROLLER FOR SMALL PLANING BOAT

CROSS-REFERENCE TO RELATED APPLICATIONS

This application is based on and claims priority to Japanese patent application Serial No. 2005-254413, filed Sep. 2, 2005, the entirety of which is hereby incorporated by reference.

BACKGROUND OF THE INVENTION

1. Field of the Invention

The present invention relates to a throttle opening controller for a small planing boat, which has a throttle valve for controlling an mount of air to be supplied to an engine.

2. Description of the Related Art

A small planing boat such as a personal watercraft may have an electronically controlled throttle valve that opens/closes by a motor operative in response to displacement of a lever by a boat operator. Displacement of the lever can be detected by a displacement detecting sensor. The throttle valve adjusts an amount of air to be supplied to the engine. Japanese patent document JP-Y-Hei 7-40476 discloses a small planing boat that has a meter on the handlebar cover. The meter has a built-in tachometer, oil indicator, coolant temperature gauge, fuel gauge, and so forth. An operator of this type of small planing boat can check the meter to monitor boat conditions, including remaining fuel amount, so as to avoid problems such as fuel shortage and overheating, which may occur during driving. Also, such instruments may be adapted to light up a warning light if any problem is indicated.

SUMMARY OF THE INVENTION

However, Applicants have noted that an operator may fail to see or notice such indications, even warning lights. If an operator continues to drive the boat without recognizing that only a little amount of fuel remains, knocking or engine stop resulting from running out of fuel may occur. Operators often drive small planing boat with the throttle valve fully opened. If the boat runs out of fuel during such high-load, high-speed driving, severe knocking occurs, which may damage the engine. In addition, a small planing boat tends to run with its running attitude of the boat body varied significantly as the boat sharply accelerates/decelerates or turns. As the small planing boat cruises, the liquid level in a fuel tank fluctuates accordingly. This makes accurate detection of the remaining fuel amount more difficult.

One object of the present invention is to provide a throttle opening controller for a small planing boat, which controller can limit opening of a throttle valve when a remaining fuel amount decreases to or below a predetermined amount.

In one embodiment, the present invention features a throttle opening controller for a small planing boat including: a throttle valve for changing the degree of opening in response to displacement of an operating member to adjust an amount of air to be supplied to an engine; a remaining fuel amount detecting means for detecting a remaining fuel amount in a fuel tank; and a throttle opening limiting means for limiting the degree of opening of the throttle valve in response to the displacement of the operating member to a predetermined value or lower when the remaining fuel amount detected by the remaining fuel amount detecting means is equal to or below a preset threshold.

According to the aspect of the present invention that features the throttle opening controller for a small planing boat, when the remaining fuel amount in the fuel tank is equal to or below the preset threshold, the throttle opening limiting means is operative to limit the degree of opening of the throttle valve in response to the displacement of the operating member to the predetermined value or lower. This reduces subsequent fuel consumption for the small planing boat to run, while allowing a boat operator to notice a change in driving condition of the engine, and therefore to certainly recognize that only a little amount of fuel remains. Consequently, the boat operator can take an appropriate action prior to running out of fuel and engine stop, such as refueling the fuel tank or decelerating the boat to return to the seashore under appropriate driving conditions.

In another embodiment, a remaining fuel amount detecting means is made up of a remaining fuel amount detector and a fuel consumption calculating means, so that when the remaining fuel amount detected by the remaining fuel amount detector is equal to or below a certain preset value, the fuel consumption calculating means starts calculating total fuel injection amount, and when a value, obtained by subtracting the total fuel injection amount from the preset value, is equal to or below the threshold, the throttle opening limiting means determines the degree of opening of the throttle valve based on a preset opening rate.

In one embodiment, the remaining fuel amount detector for detecting the remaining fuel amount is made up of a float, a rotational support rod connected to the float, and a potentiometer for detecting a rotation angle of the rotational support rod. The accuracy of such a detector can be diminished when only a small volume of fuel is remaining in the fuel tank. Thus, when the remaining fuel amount is close to the threshold (a preset value representing that the boat is almost running out of fuel), a different type of detector may be used to detect the remaining fuel amount. According to one embodiment, the fuel consumption calculating means is used to calculate fuel consumption during a period that begins when the remaining fuel amount decreases below a preset value at which the detection accuracy of the remaining fuel amount detector starts to diminish significantly, and proceeds to the threshold. Consequently, this can provide more accurate detection of the remaining fuel amount without a separate detector.

Further, another embodiment features a partition that is at least partly formed with a generally vertical plane provided in an internal space of the fuel tank. The partition provides the fuel tank with plural chambers with their bottom sections all communicated with each other, and the remaining fuel amount detector is provided in at least one of the plural chambers.

Dividing the internal space of the fuel tank into plural chambers in such a manner reduces fluctuations of the liquid level in each chamber, compared to a fuel tank with a single chamber. In other words, a difference between minimum and maximum liquid levels that fluctuate as the plural chambers individually shake is smaller than a difference between minimum and maximum liquid levels that fluctuate as the single chamber shakes. Thus, differences in remaining fuel amount detected by the remaining fuel amount detector are leveled out, thereby improving the detection accuracy. This allows the throttle opening limiting means to operate more appropriately. In this case, the bottom sections of the respective chambers need be communicated with each other in order to even the liquid levels in the respective chambers. In addition, each bottom section preferably lies below the position corresponding to at least the preset value.

In a further embodiment, the partition is made up of walls extending in plural directions when viewed in plan. In one embodiment, the plural directions refer to longitudinal and lateral directions of the fuel tank. The internal space of the fuel tank may be divided longitudinally and laterally into plural chambers in a lattice fashion. This allows the internal space of the fuel tank to be separated into smaller sections so that fluctuations of the liquid level in each chamber can be effectively reduced when the small planing boat sways back and forth or side to side. This aids accurate detection of the liquid level, independent of which chamber is provided with the remaining fuel amount detector.

A still further embodiment of the present invention features a knock detector for detecting knocking provided on an outer wall section of a cylinder body of the engine. In this embodiment, a water-cooling jacket with a closed deck structure is formed on the outer wall section of the cylinder body. Preferably, a rib for connecting an inner and an outer wall of the water-cooling jacket is provided adjacent to a mating face on the water-cooling jacket between the cylinder body and a cylinder head, and the knock detector is mounted to a place corresponding to the rib.

When the remaining fuel amount is equal to or below the preset threshold, and the degree of opening of the throttle valve is limited, subsequent fuel consumption for the small planing boat to run is reduced. However, if the boat continues to run and the remaining fuel amount further decreases, knocking occurs, which may cause the engine to be damaged. Under this condition, using the knock detector to detect knocking enables the boat operator to know the occurrence of knocking immediately, and therefore to take an appropriate action, such as closing the throttle valve, so that the engine is prevented from knocking as well as being damaged. In addition, since knocking occurs in the top section inside the cylinder, in one embodiment the knock detector is provided adjacent to the mating face between the cylinder body and the cylinder head in order to accurately detect knocking. Further, the rib preferably is provided to connect the inner and outer walls of the water-cooling jacket, and the knock detector is provided through the rib so that the knock detector can be rigidly secured while sensing engine vibrations easily.

In accordance with another embodiment, the present invention provides a small planing boat comprising a hull, an engine supported in the hull, a fuel tank, a remaining fuel detector adapted to measure the amount of fuel remaining in the fuel tank, a throttle valve adapted to open and close so as to regulate a supply of air to the engine, an acceleration input device configured to be operable by an operator of the boat, and a throttle control. The throttle control is adapted to control opening and closing of the throttle valve to generally correspond to operation of the acceleration input device by the boat operator. The throttle control is further adapted to limit the degree of opening of the throttle valve when the detected amount of fuel remaining in the tank is equal to or less than a preset threshold.

In another embodiment, the throttle control is configured so that when the detected amount of fuel remaining in the tank is equal to or less than the preset threshold, the throttle control limits the degree of opening of the throttle valve to a fractional proportion of the degree of opening corresponding to a position of the acceleration input device when the detected amount of fuel remaining in the tank is greater than the preset threshold. In a still further embodiment, the fractional proportion is less than one.

In yet another embodiment, the boat additionally comprises a fuel injector adapted to supply a measured quantity of fuel for the engine. A fuel consumption calculator is adapted to calculate a total amount of fuel supplied by the fuel injector starting when the detected amount of fuel remaining in the tank is equal to or less than a second preset threshold that is greater than the first preset threshold. Detection of when the detected amount of fuel remaining in the tank is equal to or less than the first preset threshold occurs when the calculated fuel supplied since the start of calculation equals or exceeds a preset volume.

In yet another embodiment, the fuel tank comprises at least one generally vertical partition within the fuel tank to divide the fuel tank into a plurality of chambers. The chambers are adapted to communicate with one another along lower portions of the chambers, and the remaining fuel detector is disposed in at least one of the chambers. In another embodiment the partition comprises a plurality of generally vertical walls arranged in a plurality of directions.

In still another embodiment, the engine comprises a cylinder body having an outer wall, and a knock detector for detecting knocking, and the knock detector is provided on the outer wall of the cylinder body. In a further embodiment, the engine additionally comprises a cylinder head and a cooling jacket formed in the outer wall of the cylinder body. The cooling jacket comprises an inner wall, an outer wall, and a rib for connecting the inner and the outer wall. The rib is provided adjacent a mating face on the cooling jacket between the cylinder body and the cylinder head. The knock detector is mounted at a position corresponding to the rib.

In accordance with another embodiment, the present invention provides a method of controlling throttling of a small planing boat. The method comprises providing a hull, an engine supported in the hull, a fuel tank, a remaining fuel detector adapted to measure the amount of fuel remaining in the fuel tank, a throttle valve adapted to open and close so as to regulate a supply of air to the engine, and an acceleration input device configured to be operable by an operator of the boat. The method further comprises controlling opening and closing of the throttle valve to generally correspond to operation of the acceleration input device by the boat operator, monitoring whether the detected amount of fuel remaining in the fuel tank is equal to or less than a preset threshold, and limiting the degree of opening of the throttle valve when the detected amount of fuel remaining in the tank is equal to or less than the preset threshold.

In a further embodiment, the method additionally comprises limiting the degree of opening of the throttle valve when the detected amount of fuel remaining in the tank is equal to or less than the preset threshold to a fractional proportion of the degree of opening that would correspond to a position of the acceleration input device when the detected amount of fuel remaining in the tank is greater than the preset threshold.

In a yet further embodiment, the method additionally comprises providing a fuel injector adapted to supply a measured quantity of fuel to the engine, and providing a fuel consumption calculator. The method further comprises calculating fuel consumption beginning when the detected amount of fuel remaining in the fuel tank is equal to or less than a second preset threshold that is greater than the first preset threshold, and determining when the amount of fuel remaining in the tank is equal to or less than the first preset threshold by determining when the total calculated fuel supplied since the beginning of calculation equals or exceeds a preset volume.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF PREFERRED EMBODIMENTS

Figure 1:
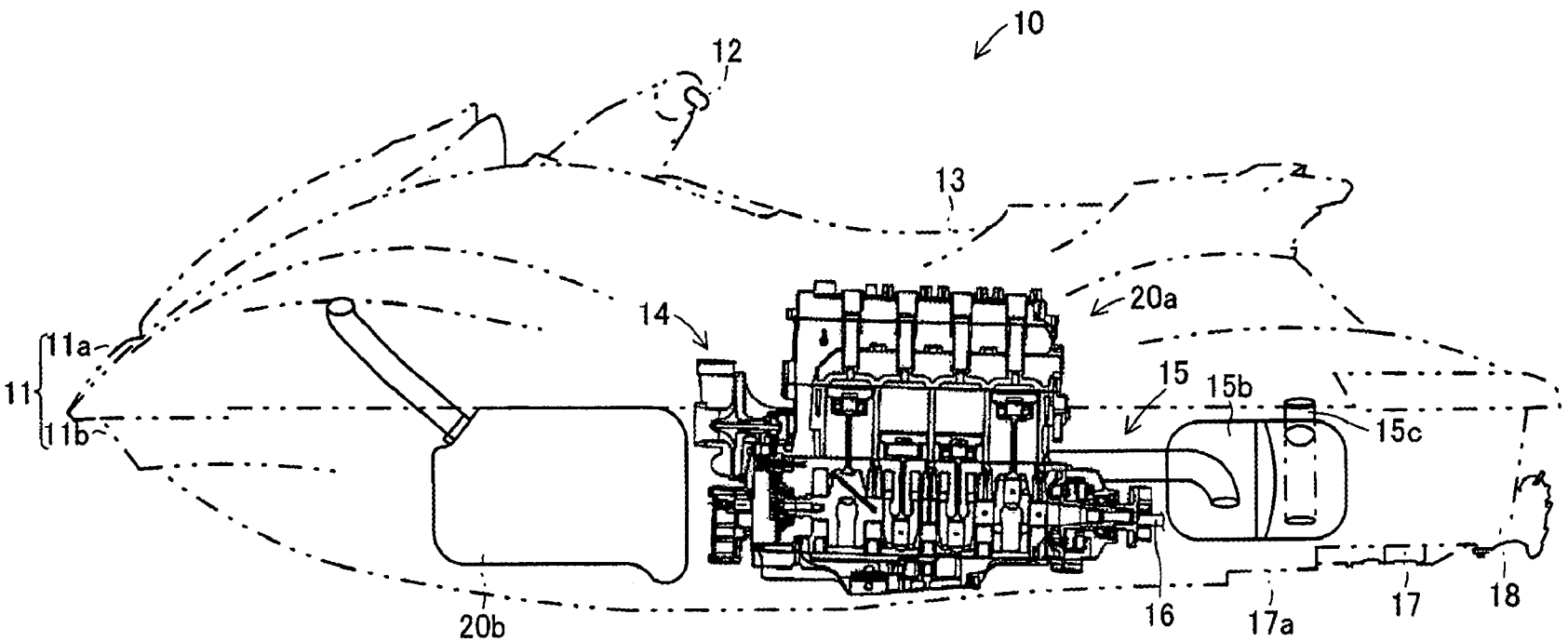
FIG. 1 is a side elevational view of a small planing boat that has a throttle opening controller according to one embodiment of the present invention.

Embodiments of the present invention are described below with reference to the drawings. FIG. 1 shows a small planing boat 10 having a throttle opening controller according to one embodiment of the present invention. In the small planing boat 10, a boat body 11 is made up of a deck 11*a* and a hull 11*b*. Steering handlebars 12 are disposed slightly at a forward side portion relative to the center of an upper section of the boat body 11, and a seat 13 is disposed in a center area of the upper section of the boat body 11. The steering handlebars 12 are attached to a top end of a steering shaft 12*a* that is disposed on the boat body 11 and are rotatable about the steering axis 12*a*.

Figure 2:
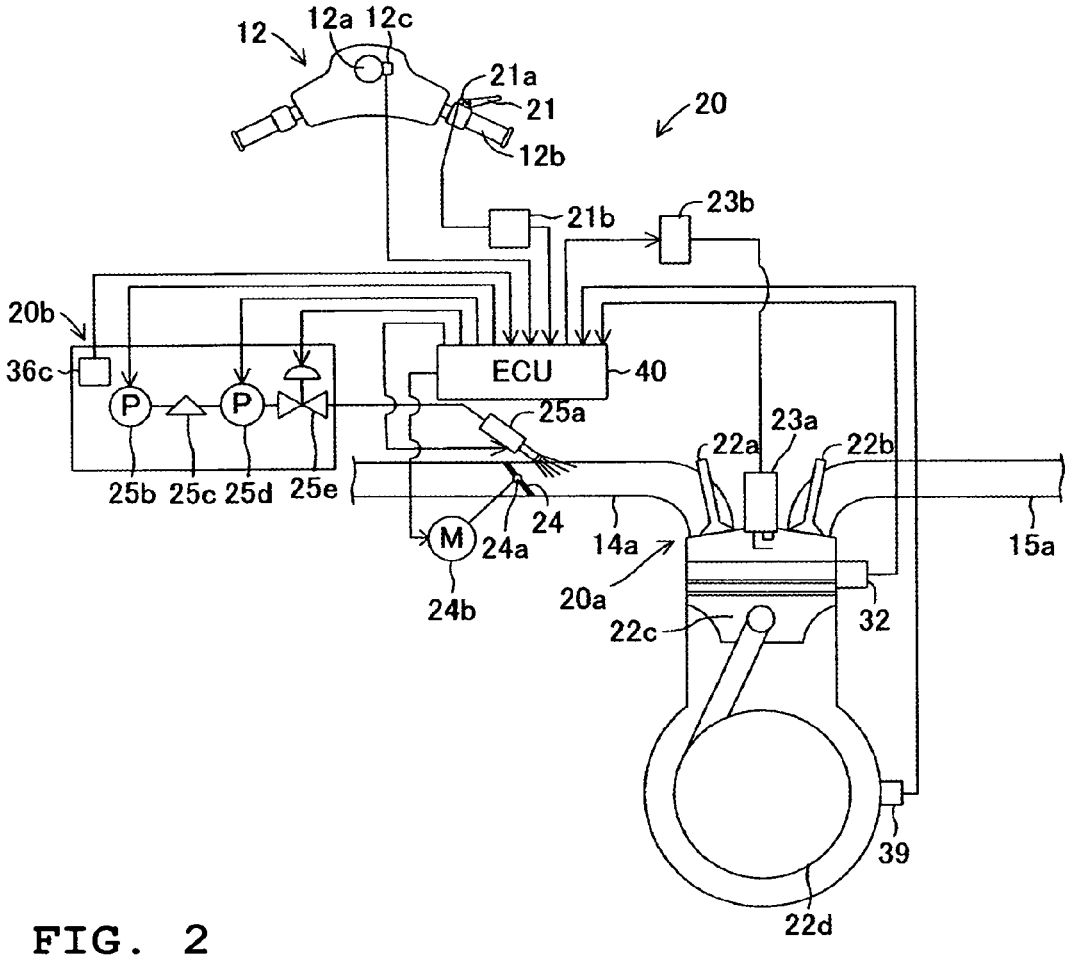
FIG. 2 is a schematic structural diagram of the throttle opening control arrangement.

With reference also to FIG. 2, a throttle lever 21 preferably is disposed adjacent to a grip 12*b* on the right side (the starboard side) of the steering handlebars 12. The throttle lever 21 is movable toward the grip 12*b* for pivot movement about a proximal end of the lever when actuated by a boat operator, and is spaced apart from the grip 12*b* when released as shown in FIG. 2. At the proximal end of the throttle lever 21 is provided a displacement detecting sensor 21*a* for detecting displacement of the throttle lever 21. Adjacent to the steering shaft 12*a* is provided a magnetostrictive sensor 12*c* for sensing a load acting on the steering handlebars 12. The magnetostrictive sensor 12*c* is designed to sense a load acting on the steering handlebars 12 that have been turned by a maximum angle, and to convert the detected load into voltage. This sensor is used for turning assist control to generate propulsion force sufficient for the small planing boat 10 to turn with the throttle lever 21 closed.

An engine 20*a* preferably is mounted in the center area of a bottom section inside of the boat body 11. A fuel tank 20*b* for accumulating fuel to be supplied to the engine 20*a* preferably is mounted at a forward side portion in the bottom section inside of the boat body 11. An intake device 14 is adapted to deliver a mixture of fuel supplied from the fuel tank 20*b* and air taken from the environment, to the engine 20*a*. An exhaust device 15 releases exhaust gases discharged from the engine 20*a* to the environment embodiment, through a rear end portion of the boat body 11. In the illustrated embodiment, the engine 20*a* is a four-cycle, four-cylinder engine. By opening and closing an intake valve 22*a* and an exhaust valve 22*b* that communicate with respective cylinders, the engine 20*a* intakes the mixture of the fuel and air through the intake device 14 disposed on the intake valve 22*a* side and sends out the exhaust gases to the exhaust device 15 disposed on the exhaust valve 22*b* side.

The mixture supplied into the engine 20*a* from the intake valve 22*a* side explodes with ignition by an ignition device that preferably includes an ignition plug 23*a* that is provided for the engine 20*a*. The explosion makes a piston 22*c* disposed inside of the engine 20*a* move up and down. The movement of the piston 22*c* rotates a crankshaft 22*d*. The crankshaft 22*d* is coupled with an impeller shaft 16 and transmits the rotational force of the engine 20*a* to the impeller shaft 16 to rotate the impeller shaft 16.

A rear end portion of the impeller shaft 16 is coupled with an impeller (not shown) of a propulsion unit 17 that preferably is mounted at a rear end portion of the boat body 11. The rotation of the impeller generates propulsion force for the small planing boat 10. That is, the propulsion unit 17 has a water inlet port 17*a* that opens in the bottom portion of the boat body 111 and a water outlet port (not shown) that opens in the stern. By ejecting sea water introduced through the water inlet port 17*a* out of the water outlet port by the rotation of the impeller, propulsion force is imparted to the boat body 11. A steering nozzle 18 is attached to the rear end portion of the propulsion unit 17. The steering nozzle 18 changes an advancing direction of the small planing boat 10 rightward or leftward by allowing its rear portion side to be moved rightward or leftward in response to operation of the steering handlebars 12.

The intake system 14 preferably is made up of an intake pipe 14*a* connected to the engine 20*a*, a throttle body connected to the upstream end of the intake pipe 14*a*, and so forth. The intake device 18 intakes air from outside the boat through an intake duct and an intake box (not shown) supplies car to the engine 20*a* through a throttle valve 24. A flow rate of the air supplied to the engine 20*a* is regulated by opening or closing operation of the throttle valve 24, which is disposed within the throttle body. The intake device 14 mixes the fuel with the air to be supplied to the engine 20*a*. The fuel is supplied from the fuel tank 20*b* through a fuel supply device that preferably includes an injector 25*a*.

The exhaust device 15 includes exhaust pipes 15*a* that are formed with winding pipes connected to the engine 20*a*, a water lock 15*b* that is shaped like a tank and is connected to a rear end portion of the exhaust pipes 15*a*, and an exhaust pipe 15*c* that is connected to a rear portion of the water lock 15*b*. The exhaust pipes 15*a* extend from the exhaust valve 22*b* side of each cylinder of the engine 20*a*, merge together on the starboard side of the boat body 11 and then extend forward. The merged exhaust pipe 15*a* surrounds the forward side portion of the engine 20*a* to extend toward the port side of the boat body 11 and then passes in the proximity of a side portion of the engine 20*a* to extend rearward in order to communicate with a forward portion of the water lock

15*b*. The exhaust pipe 15*c* preferably extends upward from the upper surface of the rear portion of the water lock 15*b* and then extends downward rearwardly, and its downstream end opens in a lower portion of the rear end of the boat body 11. The exhaust device 15 preferably discharges exhaust gases to the environment in a manner so that external seawater or the like is prevented from entering the engine 20*a* side.

The throttle valve 24 preferably is formed substantially like a disk. A pivot shaft 24*a* preferably is affixed thereto at a center portion (in the diameter direction). The pivot shaft 24*a* is pivotally supported inside of the throttle body. A motor 24*b* is connected to one end of the pivot shaft 24*a*. Thus, the throttle valve 24 pivots in the forward or reverse direction about the pivot shaft 24*a* with a rotary movement of the motor 24*b* to open or close an intake passage extending inside of the throttle body. The adjustment of the opening of the throttle valve is conducted by operating the throttle lever 21.

Figure 3:
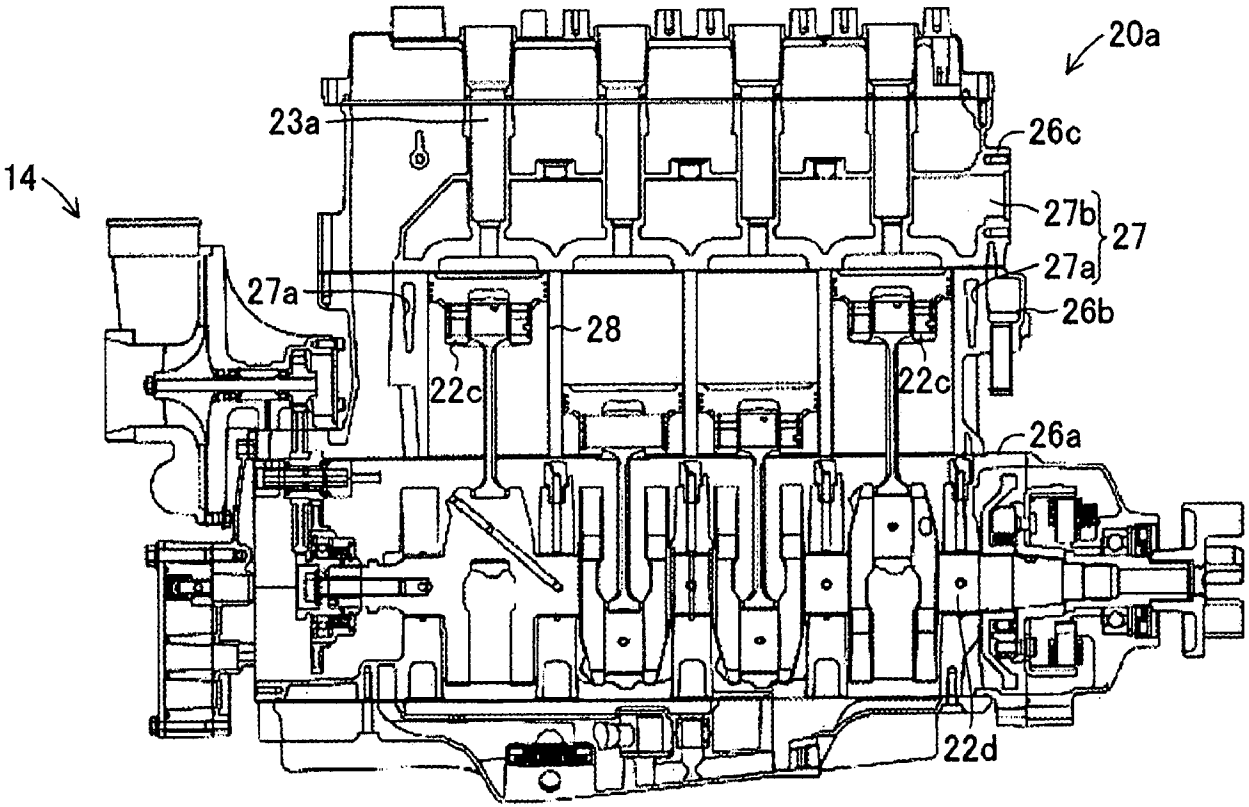
FIG. 3 is a side elevational view of an engine.
Figure 4:
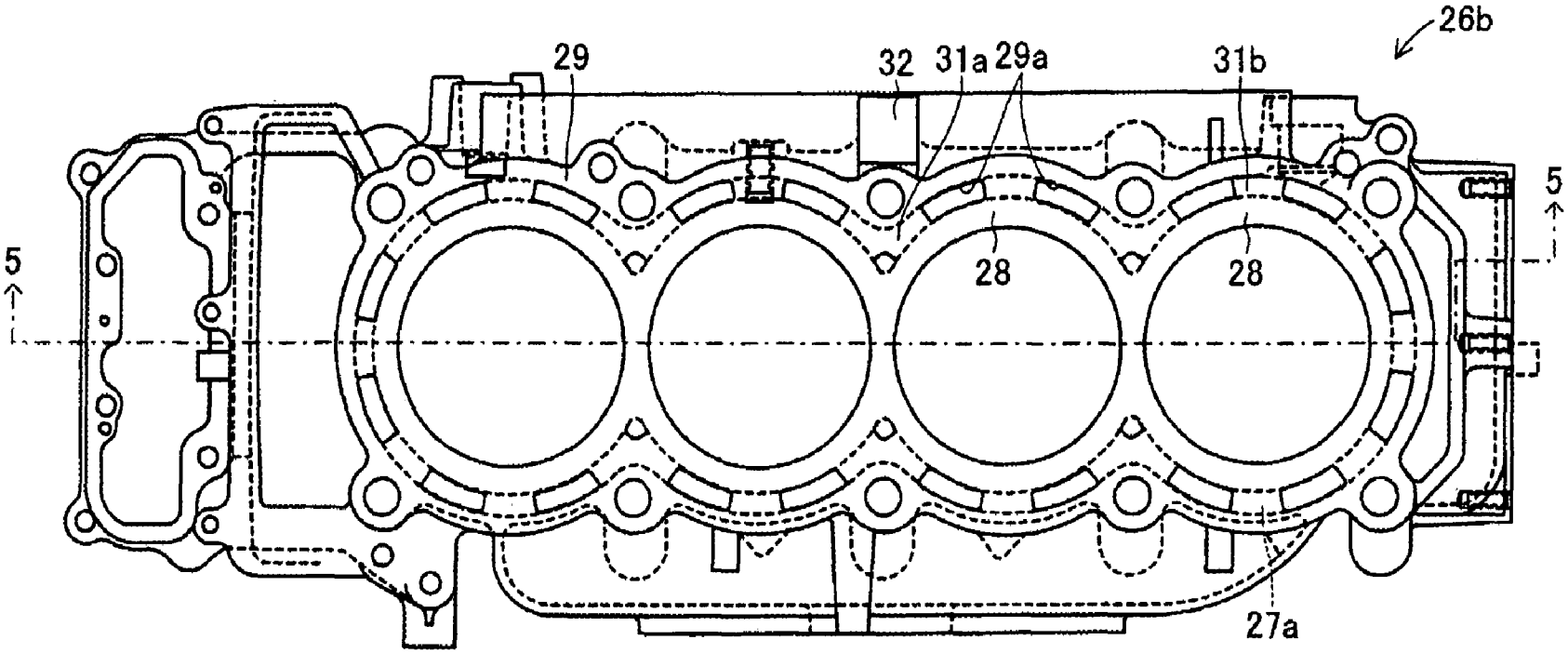
FIG. 4 is a plan view of a cylinder body.
Figure 5:
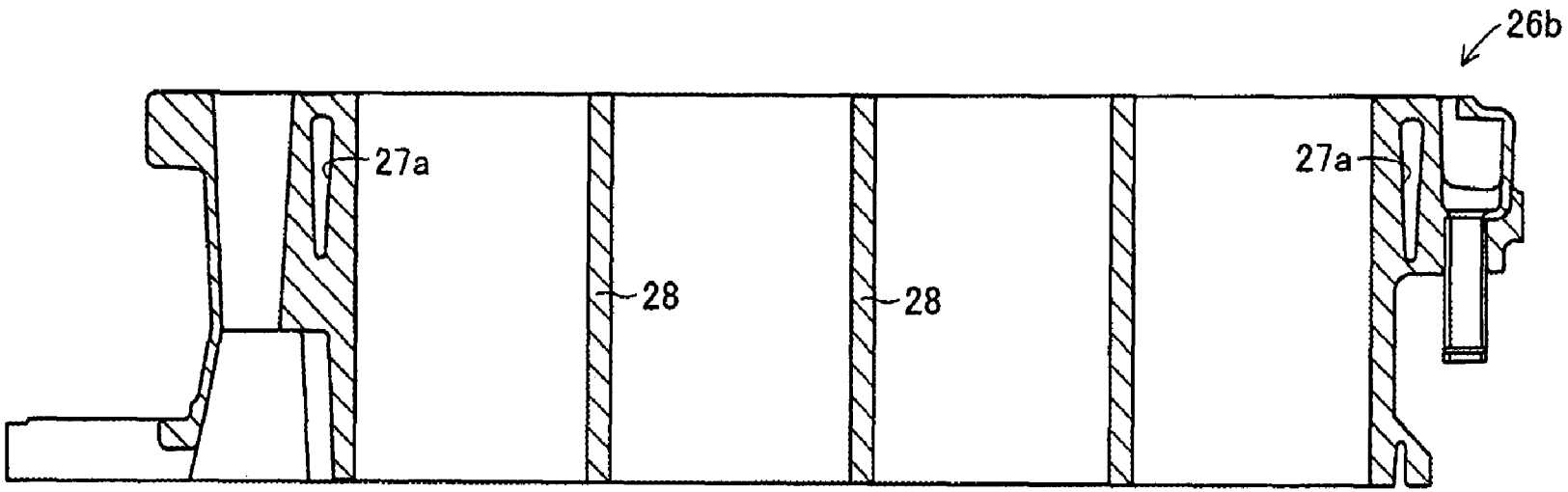
FIG. 5 is a sectional view taken along the line 5-5 of FIG. 4.

As shown in FIG. 3, a main body of the engine 20*a* is built by assembling a cylinder body 26*b* and a cylinder head 26*c* in order on the top of the crankcase 26*a* in which the crankshaft 22*d* is housed. A water jacket 27 is formed in walls defining the cylinder body 26*b* and the cylinder head 26*c*. The structure of an embodiment of the cylinder body 26*b* is shown in FIGS. 4 and 5. More specifically, FIG. 4 is a plan view of the cylinder body 26*b*, while FIG. 5 is a sectional view taken along the line 5-5 of FIG. 4.

The cylinder body 26*b* has, in its inside, cylinder barrels 28 each forming a cylindrical portion of the cylinder. A water-cooling jacket 27*a* with a closed deck structure, which surrounds the circumference of the cylinder barrel 28, makes up a lower section of the water jacket 27. The water-cooling jacket 27*a* is connected to a cooling water supply pipe (not shown) to cool the cylinder body 26*b* using cooling water fed from outside of the engine 20*a* through the cooling water supply pipe. The top end of the water-cooling jacket 27*a* communicates with the upper jacket 27*b*, which makes up an upper section of the water jacket 27 and is located within the cylinder head 26*c*, through each lead-out opening 29*a* provided with a predetermined gap from the adjacent lead-out opening on a top surface portion 29 of the cylinder body 26*b*.

The lead-out opening 29*a* surrounds the outer circumference of each cylinder barrel 28 and secures a predetermined gap from the adjacent lead-out opening. Each rib 31*a*, 31*b* for connecting the inner and outer walls of the water-cooling jacket 27*a* together is formed between the associated lead-out openings 29*a*. The rib 31*a* is provided at an approximately V-shaped portion between the adjacent cylinder barrels 28. The rib 31*b* is provided on a portion protruding from the outer side of each cylinder barrel 28. A knock sensor 32 as a knock detector of the invention is mounted to the rib 31*a* that is positioned in the longitudinal center and top end of the cylinder body 26*b* on its starboard side face. The knock sensor 32 is designed to detect knocking based on vibrations due to abnormal combustion in the engine 20*a*. Providing this knock sensor 32 in the proximity to the top end position of the piston 22*c* that moves up and down results in accurately detecting knocking.

A water drain portion (not shown) is provided on the top end of the upper jacket 27*b* formed in the cylinder head 26*c* and connects to a cooling water drainpipe. The cooling water drainpipe communicates with the rear end portion of the boat body 11 to drain cooling water out of the water drain portion to the outside location of the boat. Thus, cooling water, which is supplied from the cooling water supply pipe to the water-cooling jacket 27*a* of the cylinder body 26*b*, is fed into the upper jacket 27*b* through the lead-out opening 29*a*, and further through the water drain portion to the cooling water drainpipe to be drained out. The cooling water cools the cylinder body 26*b* and the cylinder head 26*c* by passing through these elements.

Figure 6:
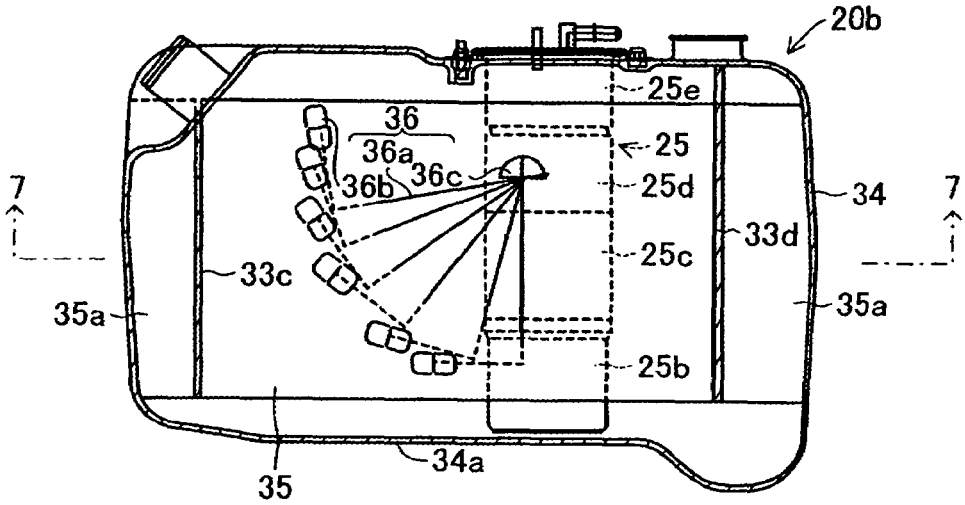
FIG. 6 is a sectional view illustrating an internal space of a fuel tank.
Figure 7:
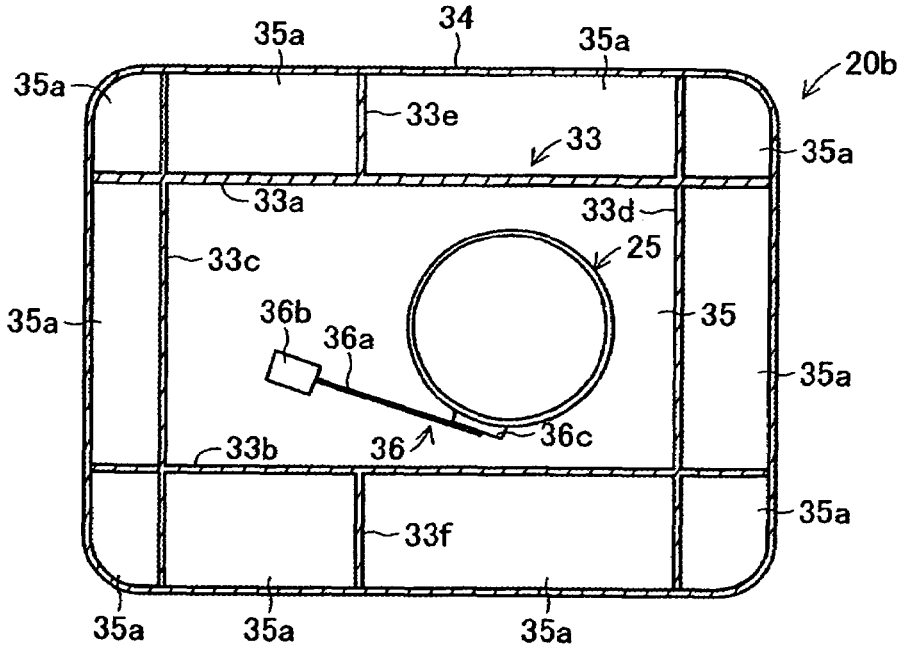
FIG. 7 is a sectional view taken along the line 7-7 of FIG. 6.

FIGS. 6 and 7 illustrate the internal space of the fuel tank 20*b*, which is divided by a vertical partition 33 as a partition of the invention into plural chambers. More specifically, the vertical partition 33 is made up of: fore-and-aft walls 33*a*, 33*b* provided on the laterally (vertically in FIGS. 6 and 7) opposite sides of the fuel tank 20*b* to extend in the fore-and-aft direction; left-and-right walls 33*c*, 33*d* provided on the longitudinally (laterally in FIGS. 6 and 7) opposite sides of the fuel tank 20*b* to extend in the lateral direction; and small partitions 33*e*, 33*f* extending between one side portion of a perimeter 34 of the fuel tank 20*b* and the fore-and-aft wall 33*a*, and between the other side portion of the perimeter 34 of the fuel tank 20*b* and the fore-and-aft wall 33*b*, respectively.

This structure allows the fuel tank 20*b* to have a large main container 35 in the center of its internal space, as well as ten (10) small sub containers 35*a* around the main container 35. The bottom end of the vertical partition 33 is positioned above a bottom surface section 34*a* of the fuel tank 20*b* with a clearance therebetween. This allows the fuel levels both in the main container 35 and the sub containers 35*a* to be even. Inside the main container 35, a fuel pump assembly 25 that forms, together with the injector 25*a*, a fuel supply device, is located. A remaining fuel amount detector 36 is attached to the fuel pump assembly 25.

In the illustrated embodiment, the remaining fuel amount detector 36 includes: a rotational support rod 36*a* attached to and vertically rotatable about a predetermined point on the side surface of the fuel pump assembly 25; a float 36*b* having a specific gravity lower than that of fuel and attached to a distal end of the rotational support rod 36*a*; and a potentiometer 36*c* provided at a proximal end of the rotational support rod 36*a* for detecting a rotation angle thereof. As the fuel level in the fuel tank 20*b* varies, the float 36*b* moves up/down. According to the up/down movements of the float 36*b*, the rotational support rod 36*a* rotates up/down by a certain angle, which is detected by the potentiometer 36*c*. Based on the value detected by the potentiometer 36*c*, the remaining fuel amount can be known.

Inside the fuel pump assembly 25 are disposed a primary pump 25*b*, a filter 25*c*, a secondary pump 25*d*, and a pressure control valve 25*e* in order from the bottom to top. The primary pump 25*b* operates to draw fuel from the fuel tank 20*b* and feed the fuel to the filter 25*c*, which filters the fuel to remove impurities, and then to the secondary pump 25*d*. The secondary pump 25*d* feeds the fuel by high pressure to the pressure control valve 25*e*, which adjusts the fuel pressure to discharge the fuel out of the fuel tank 20*b*. The pressure control valve 25*e* is connected to the injector 25*a* to feed the fuel, which has been delivered through the operation of the secondary pump 25*d*, to the injector 25*a*.

The throttle opening controller 20 according to the embodiment illustrated in FIG. 8 also preferably has various sensors and devices, such as an electronic control unit 40 (hereinafter referred to as ECU), in addition to the devices described above. For example, an acceleration sensor assembly 21*b* preferably is connected to the displacement detecting sensor 21*a*. The acceleration sensor assembly 21*b* is disposed between the throttle lever 21 and the throttle valve 24 in order to convert the displacement of the throttle lever 21 transmitted through a throttle cable into voltage and transmit the voltage to the ECU 40. The ECU 40 calculates the opening of the throttle valve 24 equivalent to the voltage and drives the motor 24*b* to open the throttle valve 24 to the position consistent with the calculated opening.

Also, an ignition coil 23*b* preferably is connected to each ignition plug 23*a*. The ignition coil 23*b* sends electric current to the ignition plugs 23*a* in accordance with ignition timing. In this manner, the ignition plugs 23*a* discharge electricity to ignite fuel. A throttle opening sensor 37 for sensing the opening of the throttle valve 24 preferably is provided adjacent to the pivot shaft 24*a* of the throttle valve 24. In one embodiment, the throttle opening controller 20 further has a buzzer 38 for generating a warning sound when the knock sensor 32 senses knocking. An engine speed sensor 39 for sensing an engine speed preferably is also provided near the engine 20*a*.

Figure 8:
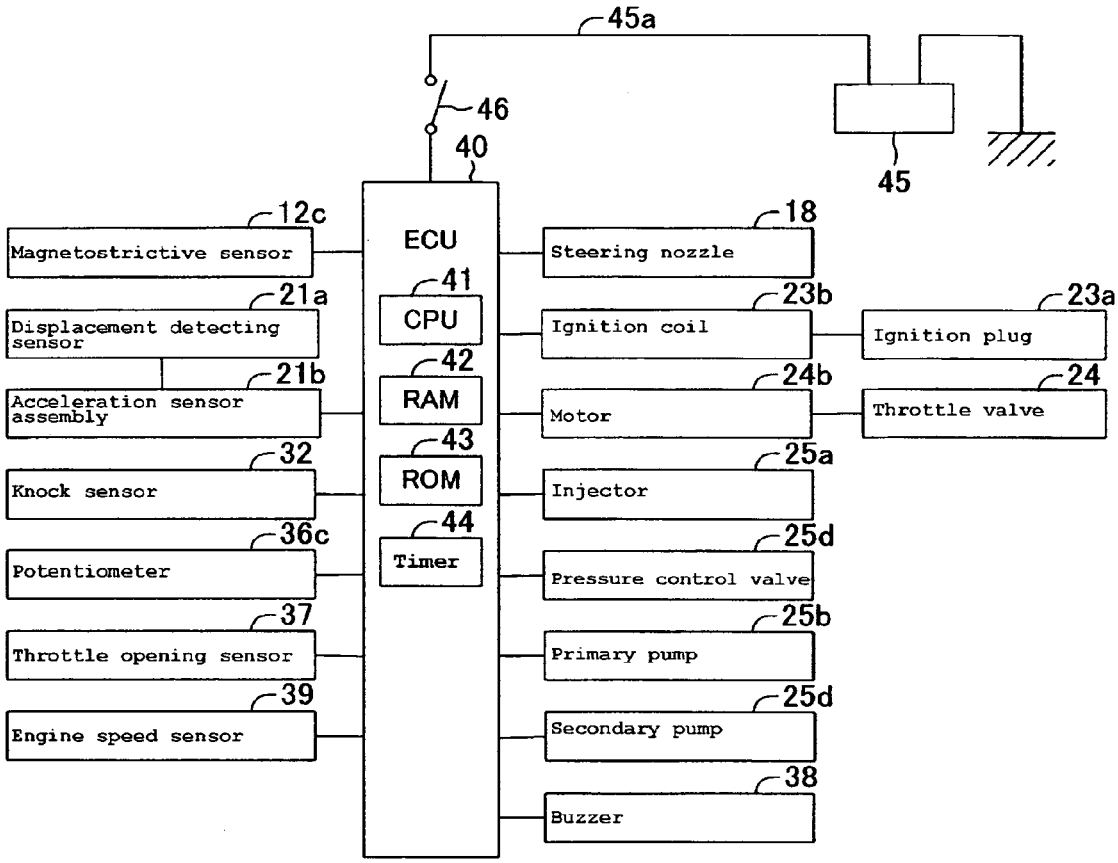
FIG. 8 is a schematic diagram of the throttle opening controller.

As shown in FIG. 8, the ECU 40 preferably includes a CPU 41, a RAM 42, a ROM 43, a timer 44 and various circuit devices (not shown). Detection signals from the various sensors, such as the displacement detecting sensor 21*a* for indicating operative conditions of the throttle lever 21, and the potentiometer 36*c* for indicating a remaining fuel amount in the fuel tank 20*b*, are inputted to the ECU 40. The ECU 40 computes and processes the detection signals from the various sensors based upon control maps stored in the ROM 43, and then transmits control signals to the injectors 25*a*, the ignition coil 23*b*, the motor 24*b*, the primary pump 25*b*, the secondary pump 25*d*, the pressure control valve 25*e* and so forth.

Also, the ECU 40 is connected to a battery 45 through a power source line 45*a*. An ignition switch 46 is disposed in the power source line 45*a*. The ignition switch 46 is turned on or off by operation of the boat operator. Electric power is supplied to the ECU 40 when the ignition switch 46 is turned on.

Descriptions are next made on controls performed by the throttle opening controller 20 to drive the small planing boat 10 configured as above. First, the boat operator turns on the ignition switch 46, and in this manner the small planing boat 10 comes to a condition that it is ready to start. Then, with the boat operator's operation of the steering handlebars 12 and the throttle lever 21 disposed on the grip 12*b*, the small planing boat 10 runs in a direction and at a speed both according to the respective operations.

Figure 9:
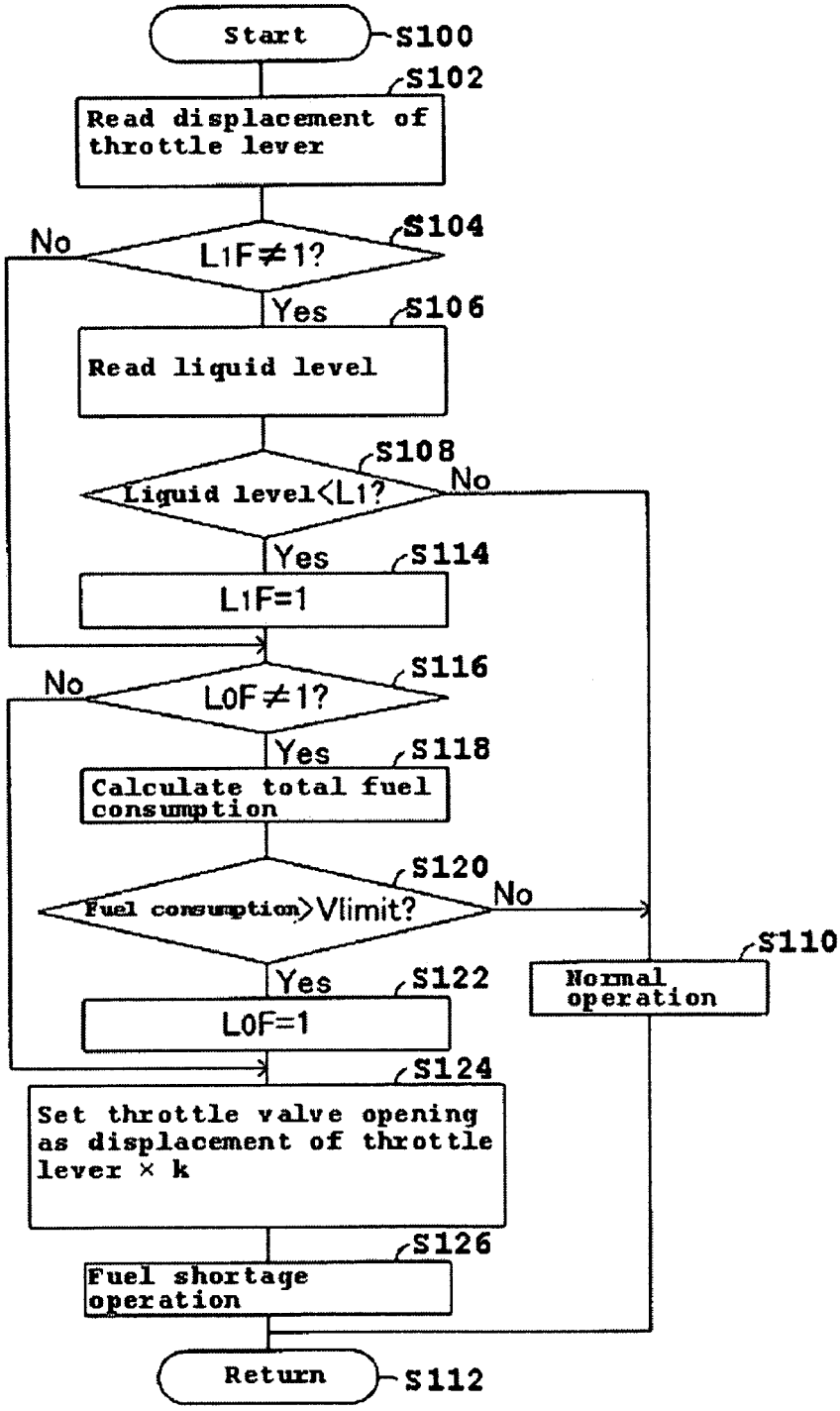
FIG. 9 is a flowchart of a program to be conducted by a CPU.

Controlling of the opening of the throttle valve 24 preferably is conducted in accordance with a program of a flowchart shown in FIG. 9 and is repeated every preset time after the ignition switch 46 has reached the ON condition. The program first starts at a step S100. Then, the program goes to a step S102, where the CPU 41 reads displacement of the throttle lever 21 detected by the displacement detecting sensor 21*a*, and uses the RAM 42 to store the displacement value. Then, the program goes to a step S104, where the CPU 41 determines whether or not a preset value flag L1F is unequal to "1 (one)."

The preset value flag L1F of "1" indicates that the fuel level L reaches or falls below a certain preset value L1 shown in FIG. 10, while the preset value flag L1F of "0 (zero)" indicates that the fuel level L exceeds a certain preset value L1. Also, the preset value flag L1F is reset to "0" at the time when the program starts to run. Accordingly, the CPU 41 determines "YES" in the step S104 and the program goes to a step S106. In the step S106, the CPU 41 reads the fuel level detected by the potentiometer 36*c* of the remaining fuel amount detector 36, and uses the RAM 42 to store the value of the fuel level.

Next, the program goes to a step S108, where the CPU 41 determines whether or not the fuel level L reaches or falls below the preset value L1. If the remaining fuel amount in the fuel tank 20*b* is sufficient enough for the small planing boat 10 to continue running, and the value detected by the potentiometer 36*c* is greater than the preset value L1, the CPU determines "NO" and goes to a step S110. In the step S110, the CPU 41 drives the motor 24*b* in response to the displacement of the throttle lever 21 stored in the RAM 42, in order to open the throttle valve 24.

This allows the small planing boat 10 to run under normal operation. Under this condition, the injector 25*a* injects fuel to the engine 20*a* to mix the fuel with the air passing through the throttle valve 24, in order to supply the mixture to the engine 20*a*. An amount of fuel to be injected is determined based on a 3D-map stored in the ROM 43, which represents a relationship between engine speed, throttle opening and fuel injection amount. Then, the program goes to a step S112 and temporarily ends.

The program restarts from the step S100 and goes to the step S102. In the step S102, the CPU 41 reads displacement of the throttle lever 21 detected by the displacement detecting sensor 21*a* and uses the RAM 42 to store (update) the displacement value, and the program goes to the step S104, where the CPU 41 determines whether or not the preset value flag L1F is unequal to "1." Because the preset value flag L1F remains "0," "YES" is determined in the step S104, and the program goes to the step S106. In the step S106, the CPU 41 reads the fuel level L detected by the potentiometer 36*c* and uses the RAM 42 to store (update) the value of the fuel level. Then, the program goes to the step S108, where the CPU 41 determines whether or not the fuel level L reaches or falls below the preset value L1.

If the value detected by the potentiometer 36*c* is greater than the preset value L1, "NO" is determined, and the program goes to the step S110, where the CPU 41 allows normal operation in response to the displacement of the throttle lever 21 to continue. Then, the program goes to a step S112 and temporarily ends. Again, the program restarts from the step S100, and repeats the steps S100 to S112, until "YES" is determined in the step S108, that is, the value detected by the potentiometer 36*c* is below the preset value L1. While conducting these steps, the small planing boat 10 continues to run under normal operation.

Figure 10:
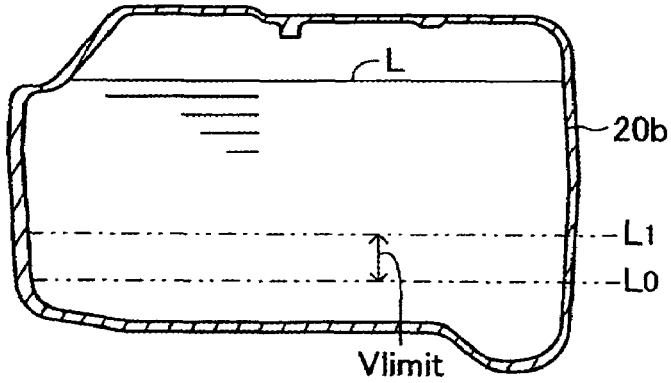
FIG. 10 is an explanatory sectional view of a fuel tank illustrating a relationship between a preset value and a threshold of a remaining fuel amount.

If the liquid level in the fuel tank 20*b* descends to the preset value L1 shown in FIG. 10, and the value detected by the potentiometer 36*c* becomes the preset value L1, "YES" is determined in the step S108. The program goes to the step S114. In the step S114, a process in which the preset value flag L1F is set to "1" is conducted. Then, the program goes to a step S116, where the CPU 41 determines whether or not a threshold flag L0F is set unequal to "1."

The threshold flag L0F of "1" indicates that the fuel level reaches or falls below a threshold L0 shown in FIG. 10, while the threshold flag L0F of "0" indicates that the fuel level exceeds a threshold L0. The threshold L0 is a preset value to indicate that a very little amount of fuel remains and the boat is almost running out of fuel. Also, the threshold flag L0F is reset to "0" at the time when the program starts to run. Accordingly, the CPU 41 determines "YES" in the step S116 and the program goes to a step S118. In the step S118, a process in which total fuel consumption is calculated is conducted. The total fuel consumption is obtained by summing up all the fuel injection amounts per time period. The CPU 41 conducts this calculation based on a program stored in the ROM 43.

Subsequently, the program goes to the step S120, where the CPU 41 determines whether or not the total fuel consumption is equal to or greater than a given amount Vlimit.

The given amount Vlimit is a preset value to indicate fuel consumption during a period that the liquid level L descends from the preset value L1 to the threshold L0. Thus, when the calculated total fuel consumption becomes the given amount Vlimit, the CPU 41 determines that the fuel level reaches the threshold L0. In turn, if the calculated total fuel consumption is below the given amount Vlimit, and "NO" is determined, the program goes to the step S110, and the CPU 41 drives the throttle valve 24 in response to the displacement of the throttle lever 21, so that the small planing boat 10 can continue to run under normal operation. Then, the program goes to a step S112 and temporarily ends.

Then, the program restarts from the step S100, and goes to the step S102, where the CPU 41 reads displacement of the throttle lever 21 detected by the displacement detecting sensor 21*a*, and uses the RAM 42 to store the displacement value. Then, the program goes to the step S104, where the CPU 41 determines whether or not the preset value flag L1F is unequal to "1." Because the preset value flag L1F has been already set to "1" in the step S114 during the last conduct of the program, "NO" is determined in the step S104 and the program goes to the step S116. In the step S116, the CPU 41 determines whether or not the threshold flag L0F is unequal to "1."

Because the threshold flag L0F remains "0," "YES" is determined in the step S116, and the program goes to the step S18. Then, in the step S18, the process in which total fuel consumption is calculated is conducted. Subsequently, the program goes to the step S120. In the step S120, the CPU 41 determines whether or not the calculated total fuel consumption is equal to or greater than the given amount Vlimit. If "NO" is determined, that is, the calculated total fuel consumption is below the given amount Vlimit, the program goes to the step S110 in which the small planing boat 10 continues to run under normal operation. Then, the program goes to the step S112 and temporarily ends.

Further, the program restarts from the step S100, and repeats the steps S100, S102, S104, S116, S118, S120, S110, S112, until "YES" is determined in the step S120, that is, the calculated total fuel consumption is equal to or greater than the given amount Vlimit. While conducting these steps, the small planing boat 10 continues to run under normal operation in response to the displacement of the throttle lever 21, and the CPU 41 updates the calculated total fuel consumption and uses the RAM 42 to store the updated value.

If "YES" is determined in the step S120, that is, the calculated total fuel consumption is equal to or greater than the given amount Vlimit, the program goes to the step S122 to set the threshold flag L0F to "1." Then, the program goes to the step S124 to conduct a process in which the product of the two values: displacement of the throttle lever 21 read in the step S102, and opening rate (k), is set as throttle valve opening. The opening rate (k) represents a degree of opening of the throttle valve 24 relative to displacement of the throttle lever 21, and is preset to a coefficient below "1." This prevents the throttle valve 24 from being fully opened, even if operation of the throttle lever 21 is intended for fully opening the throttle valve 24.

The program next goes to a step S126, in which the CPU 41 drives the motor 24*b* in response to the throttle opening obtained in the step S124 to open the throttle valve 24. Thus, the small planing boat 10 runs under fuel shortage operation, in which the running speed is limited to lower than the speed under normal operation. The program then goes to the step S112 and temporarily ends. The program restarts from the step S100, and goes to the step S102, where the CPU 41 reads displacement of the throttle lever 21 detected by the displacement detecting sensor 21*a*, and uses the RAM 42 to store the displacement value.

The program then goes to the step S104, where the CPU 41 determines whether or not the preset value flag L1F is unequal to "1." Because the preset value flag L1F is set to "1," "NO" is determined in the step S104, and the program goes to the step S116. Because the threshold flag L0F has already been set to "1" in the step S122 during the last conduct of the program, "NO" is determined in the step S116 and the program goes to the step S124.

In the step S124, the process, in which the product of the two values: displacement of the throttle lever 21 read in the step S102 and the opening rate (k), is set as throttle valve opening, is conducted. In the step S126, the process to allow the small planing boat 10 to run under fuel shortage operation is conducted in response to the throttle opening obtained in the step S124. The program goes back to the step S100 to repeat the steps S100, S102, S104, S116, S124, S126, S112.

While conducting these steps, the boat operator drives the small planing boat 10 such that the boat continues to run under fuel shortage to head to the seashore or port at his/her discretion. If the boat is almost running out of fuel in the fuel tank 20*b*, and the knock sensor 32 senses knocking, the boat operator turns off the ignition switch 46 to deactivate the engine 20*a*. This can prevent the engine 20*a* from being damaged. The fuel tank 20*b* is refueled with the engine 20*a* deactivated. After refueling, the boat operator activates the engine 20*a*. Thereby, the aforementioned steps are repeated.

As described above, in the small planing boat 10 having the throttle opening controller 20 according to the embodiment of the invention, when the remaining fuel amount in the fuel tank 20*b* is equal to or below the threshold L0, the opening of the throttle valve 24 is controlled such that the opening is equal to the product of the two values: opening of the throttle valve 24 in response to the displacement of the throttle lever 21 and opening rate (k). Because the opening rate (k) is preset to a coefficient below "1," subsequent fuel consumption for the small planing boat 10 to run is reduced after the remaining fuel amount has reached or fallen below the threshold L0. This also allows the boat operator to notice a change in driving condition of the engine 20*a*, and therefore to recognize that only a little amount of fuel remains. Consequently, the boat operator can take an appropriate action prior to running out of fuel and engine 20*a* stop, such as refueling the fuel tank, and decelerating the boat to return to the seashore under appropriate driving conditions.

As discussed above, in a preferred embodiment, when the remaining fuel amount reaches or falls below the preset value L1, total fuel injection amount is calculated in order to obtain fuel consumption, rather than detecting the remaining fuel amount by the remaining fuel amount detector 36. The threshold L0 is set as a value obtained by subtracting the calculated total fuel consumption from the preset value L1. This provides an accurate way independent from the fuel detector 36 for determining when the remaining fuel amount reaches the threshold L0. Applicants have noted that certain embodiments of fuel detectors 36 may have reduced accuracy as the fuel level within the fuel tank lowers. For example, in the illustrated embodiment, the remaining fuel amount detector 36 detects the liquid level L using the rotational support rod 36*a*, which is rotatable by an angle in accordance with the lowering liquid level L. The rate of change of the angle with the liquid level L changes between when the liquid level L lies high and when the liquid level L lies lower. This change in angle can cause the detection accuracy of the potentiometer 36*c* to drop.

As described in this embodiment, obtaining fuel consumption after the liquid level L reaches or falls below the preset value L1 can provide more accurate calculation of the remaining fuel amount. In addition, in this embodiment, the vertical partition 33 is provided in the internal space of the fuel tank 20*b* to have the main container 35 and the plural sub containers 35*a* with their bottom sections all communicated with each other. The remaining fuel amount detector 36 is provided in the central main container 35. Dividing the internal space of the fuel tank 20*b* into plural chambers in such a manner reduces allows fluctuations of the liquid level in the main container 35 incident to movement of the boat. This improves the accuracy of the detection of the remaining fuel amount performed by the remaining fuel amount detector 36.

The vertical partition 33, which is made up of the walls 33*a* to 33*f* that extend longitudinally or laterally of the fuel tank 20*b*, allows the internal space of the fuel tank 20*b* to be separated into smaller sections, so that the fluctuations of the liquid level in the main container 35 can be effectively reduced when the small planing boat 10 sways back and forth or side to side. In addition, the knock sensor 32 is provided on the outer wall section of the cylinder body 26*b* of the engine 20*a*, which allows the boat operator to know of the occurrence of knocking due to running out of fuel. When made aware of such knocking, the operator can take an appropriate action, such as deactivating the engine 20*a*. This can avoid the engine 20*a* from knocking, and therefore, from being damaged. Further, the knock sensor 32 is attached to the rib 31*a* provided adjacent to the mating face between the cylinder body 26*b* and the cylinder head 26*c*, thereby accurately detecting knocking.

Figure 11:
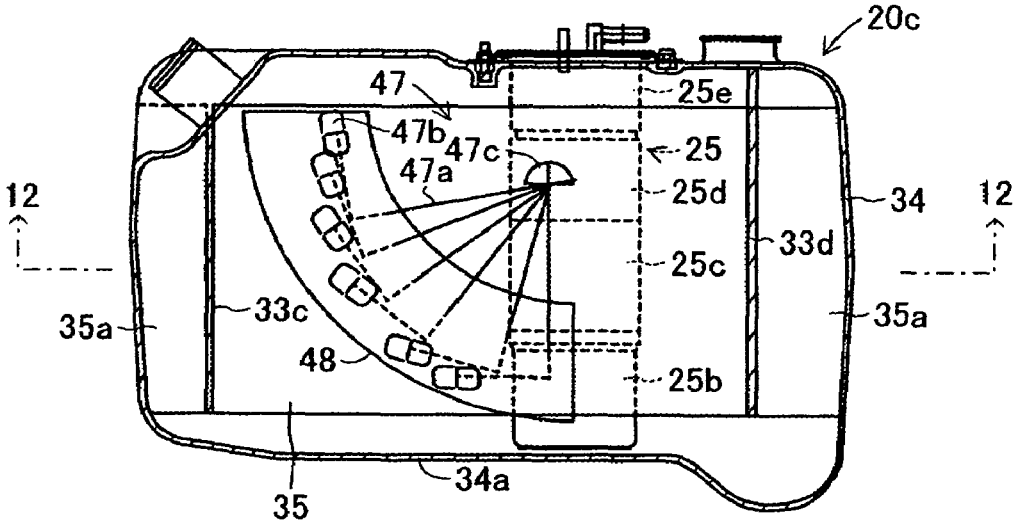
FIG. 11 is a sectional view illustrating an internal space of a fuel tank according to another embodiment of the present invention.
Figure 12:
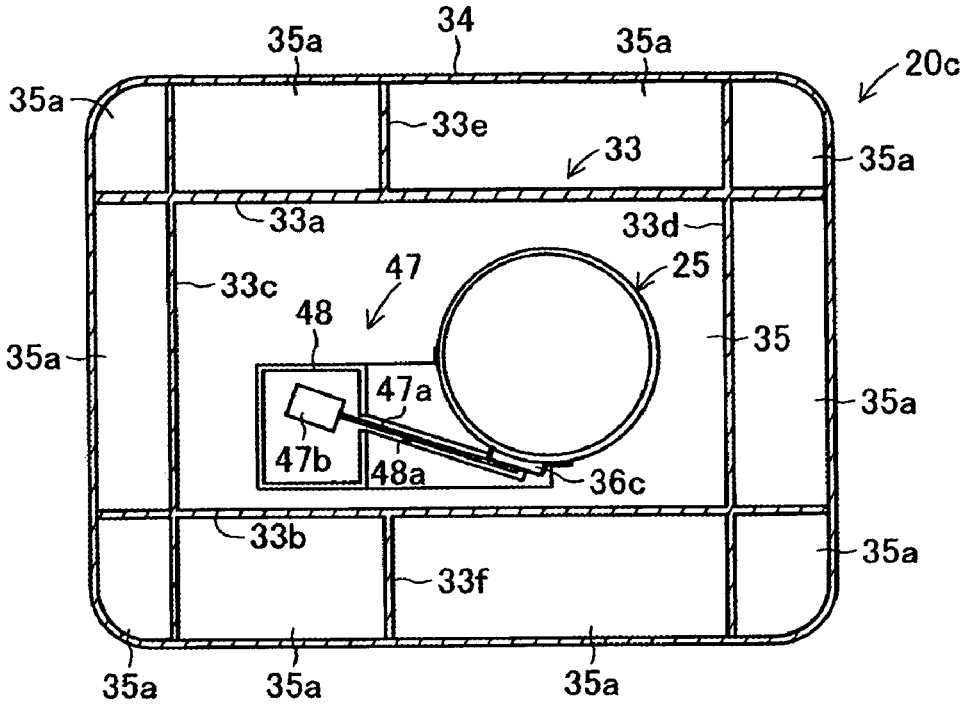
FIG. 12 is a sectional view taken along the line 12-12 of FIG. 11.

FIGS. 11 and 12 illustrate a fuel tank 20*c* according to another embodiment of the invention. In the fuel tank 20*c*, a remaining fuel amount detector 47 is provided with a cylindrical guide 48 having an arcuate shape in side view. A rotational support rod 47*a* with a float 47*b* preferably is designed to rotate in the internal space of the guide 48. More specifically, a guide aperture 48*a* is formed vertically along the inner peripheral side surface of the guide 48, such that the rotational support rod 47*a* passes through the guide aperture 48*a* to extend to the internal space of the guide 48 and the float 47*b* is positioned in the guide 48. Components of the fuel tank 20*c*, other than those described above, are identical with those which of the fuel tank 20*b* according to the embodiment previously noted. The identical components are thus denoted by the same reference numerals, and a detailed description will not be repeated.

Use of the fuel tank 20*c* prevents the rotational support rod 47*a* with the float 47*b* from being affected by varying fuel level in the main container 35, thereby providing more accurate detection. In addition, the guide 48 helps protect the rotational support rod 47*a* with the float 47*b* from being damaged. Other effects of the fuel tank 20*c* are the same as those which achieved by the fuel tank 20*b* according to the embodiment previously noted.

The throttle opening controller according to the present invention is not limited to the foregoing embodiment, and may be practiced with proper modifications. For example, in the foregoing embodiment, the remaining fuel amount detector, denoted by reference numeral 36, is made up of the rotational support rod 36*a*, the float 36*b*, and the potentiometer 36*c*. However, a different type of sensor may be used as the remaining fuel amount detector. In addition, in the foregoing embodiment, the remaining fuel amount detector 36 is used to detect the remaining fuel amount until the liquid level L reaches the preset value L1, and then a fuel consumption calculating means is used to calculate total fuel injection amount after the liquid level L reaches or falls below the preset value L1 and until it reaches the threshold L0. In another embodiment, a certain remaining fuel amount detector may be used constantly to detect the remaining fuel amount until the liquid level L reaches the threshold L0.

The shape of the vertical partition of the fuel tank 20*b* is not limited to the aforementioned one, but may be any shape that allows the internal space of the fuel tank 20*b* to be divided into plural chambers when viewed from above. In addition, the location of the remaining fuel amount detector 36 is not limited to the central chamber or the main container 35, but may be at another chamber. Further, the location of the knock sensor 32 is not limited to a place corresponding to the rib 31*a*, but may be at a place corresponding to the rib 31*b* or another place on the cylinder head 26*c* or the like. Other components that form the invention may also be modified within the technical scope of the invention.

Although the inventions herein have been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A small planing boat comprising a hull, an engine supported in the hull, a fuel tank, a remaining fuel detector adapted to measure the amount of fuel remaining in the fuel tank, a throttle valve adapted to open and close so as to regulate a supply of air to the engine, an acceleration input device configured to be operable by an operator of the boat, and a throttle control, the throttle control adapted to control opening and closing of the throttle valve to generally correspond to operation of the acceleration input device by the boat operator, the throttle control further adapted to limit the degree of opening of the throttle valve when the detected amount of fuel remaining in the tank is equal to or less than a preset threshold.

2. The small planing boat of claim 1, wherein the throttle control is configured so that when the detected amount of fuel remaining in the tank is equal to or less than the preset threshold, the throttle control limits the degree of opening of the throttle valve to a fractional proportion of the degree of opening corresponding to a position of the acceleration input device when the detected amount of fuel remaining in the tank is greater than the preset threshold.

3. The small planing boat of claim 2, wherein the fractional proportion is less than one.

4. The small planing boat of claim 3, wherein the fractional proportion is sufficiently small so that the operator will notice a substantial reduction in engine performance when the detected amount of fuel remaining in the tank is less than the preset threshold.

5. The small planing boat of claim 2 additionally comprising a fuel injector adapted to supply a measured quantity of fuel for the engine, and a fuel consumption calculator adapted to calculate a total amount of fuel supplied by the fuel injector starting when the detected amount of fuel remaining in the tank is equal to or less than a second preset threshold that is greater than the first preset threshold, wherein detection of when the detected amount of fuel remaining in the tank is equal to or less than the first preset threshold occurs when the calculated fuel supplied since the start of calculation equals or exceeds a preset volume.

6. The small planing boat of claim 5, wherein the fuel tank comprises at least one generally vertical partition within the fuel tank to divide the fuel tank into a plurality of chambers, the chambers adapted to communicate with one another along lower portions of the chambers, and the remaining fuel detector is disposed in at least one of the chambers.

7. The small planing boat of claim 6, wherein the partition comprises a plurality of generally vertical walls arranged in a plurality of directions.

8. The small planing boat of claim 2, wherein the fuel tank comprises at least one generally vertical partition within the fuel tank to divide the fuel tank into a plurality of chambers, the chambers adapted to communicate with one another along lower portions of the chambers, and the remaining fuel detector is disposed in at least one of the chambers.

9. The small planing boat of claim 8, wherein the partition comprises a plurality of generally vertical walls arranged in a plurality of directions.

10. The small planing boat of claim 6, wherein the engine comprises a cylinder body having an outer wall, and a knock detector for detecting knocking, and the knock detector is provided on the outer wall of the cylinder body.

11. The small planing boat of claim 10, wherein the engine additionally comprises a cylinder head and a cooling jacket formed in the outer wall of the cylinder body, the cooling jacket comprising an inner wall, an outer wall, and a rib for connecting the inner and the outer wall, the rib provided adjacent a mating face on the cooling jacket between the cylinder body and the cylinder head, and the knock detector is mounted at a position corresponding to the rib.

12. The small planing boat of claim 1, wherein the engine comprises a cylinder body having an outer wall, and a knock detector for detecting knocking, and the knock detector is provided on the outer wall of the cylinder body.

13. The small planing boat of claim 12, wherein the engine additionally comprises a cylinder head and a cooling jacket formed in the outer wall of the cylinder body, the cooling jacket comprising an inner wall, an outer wall, and a rib for connecting the inner and the outer wall, the rib provided adjacent a mating face on the cooling jacket between the cylinder body and the cylinder head, and the knock detector is mounted at a position corresponding to the rib.

14. A method of controlling throttling of a small planing boat, comprising providing a hull, an engine supported in the hull, a fuel tank, a remaining fuel detector adapted to measure the amount of fuel remaining in the fuel tank, a throttle valve adapted to open and close so as to regulate a supply of air to the engine, and an acceleration input device configured to be operable by an operator of the boat, controlling opening and closing of the throttle valve to generally correspond to operation of the acceleration input device by the boat operator, monitoring whether the detected amount of fuel remaining in the fuel tank is equal to or less than a preset threshold, and limiting the degree of opening of the throttle valve when the detected amount of fuel remaining in the tank is equal to or less than the preset threshold.

15. The method of claim 14 additionally comprising limiting the degree of opening of the throttle valve when the detected amount of fuel remaining in the tank is equal to or less than the preset threshold to a fractional proportion of the degree of opening that would correspond to a position of the acceleration input device when the detected amount of fuel remaining in the tank is greater than the preset threshold.

16. The method of claim 15, wherein the fractional proportion is less than one.

17. The method of claim 14 additionally comprising providing a fuel injector adapted to supply a measured quantity of fuel to the engine, providing a fuel consumption calculator, calculating fuel consumption beginning when the detected amount of fuel remaining in the fuel tank is equal to or less than a second preset threshold that is greater than the first preset threshold, and determining when the amount of fuel remaining in the tank is equal to or less than the first preset threshold by determining when the total calculated fuel supplied since the beginning of calculation equals or exceeds a preset volume.

18. A throttle opening controller for a small planing boat comprising a throttle valve for changing the degree of opening in response to displacement of an operating member to adjust an amount of air to be supplied to an engine, a remaining fuel amount detecting means for detecting a remaining fuel amount in a fuel tank, and a throttle opening limiting means for limiting the degree of opening of the throttle valve in response to the displacement of the operating member to a predetermined value or lower when the remaining fuel amount detected by the remaining fuel amount detecting means is equal to or below a preset threshold.

19. The throttle opening controller for a small planing boat according to claim 18, wherein the remaining fuel amount detecting means comprises a remaining fuel amount detector and a fuel consumption calculating means, wherein when the remaining fuel amount detected by the remaining fuel amount detector is equal to or below a certain preset value, the fuel consumption calculating means starts calculating total fuel injection amount, and when a value obtained by subtracting the total fuel injection amount from the preset value is equal to or below the threshold the throttle opening limiting means determines the degree of opening of the throttle valve based on a preset opening rate.

20. The throttle opening controller for a small planing boat according to claim 19, wherein a partition that comprises a generally vertical plane is provided in an internal space of the fuel tank so as to provide the fuel tank with plural chambers having bottom sections that all communicate with each other, and the remaining fuel amount detector is provided in at least one of the plural chambers.

21. The throttle opening controller for a small planing boat according to claim 20, wherein the partition is made up of walls extending in plural directions in a plan view.

22. The throttle opening controller for a small planing boat according to claim 21, wherein a knock detector for detecting knocking is provided on an outer wall section of a cylinder body of the engine.

23. The throttle opening controller for a small planing boat according to claim 22, wherein a water-cooling jacket having a closed deck structure is formed on the outer wall section of the cylinder body, a rib for connecting an inner and an outer wall of the water-cooling jacket is provided adjacent to a mating face on the water-cooling jacket between the cylinder body and a cylinder head, and the knock detector is mounted to a place corresponding to the rib.

* * * * *